US006563273B2

(12) United States Patent
Birrell

(10) Patent No.: US 6,563,273 B2
(45) Date of Patent: May 13, 2003

(54) TWO-WIRE CONTROLLED SWITCHING

(75) Inventor: Peter Birrell, Queenscliff (AU)

(73) Assignee: H.P.M. Industries Pty Ltd, Waterloo (AU)

( * ) Notice: Subject to any disclaimer, the term of this patent is extended or adjusted under 35 U.S.C. 154(b) by 0 days.

(21) Appl. No.: 09/729,023

(22) Filed: Dec. 4, 2000

(65) Prior Publication Data

US 2002/0067138 A1 Jun. 6, 2002

(51) Int. Cl.[7] ..... H05B 37/02
(52) U.S. Cl. ..... 315/291; 315/362
(58) Field of Search ..... 315/134, 136, 315/159, 158, 291, 307, 209 R, 362; 307/112

(56) References Cited

U.S. PATENT DOCUMENTS 3,733,528 A * 5/1973 Gilbreath ..... 315/291
4,520,295 A * 5/1985 Bolhuis ..... 315/128
4,587,459 A * 5/1986 Blake ..... 315/158
4,797,599 A * 1/1989 Ference et al. ..... 315/194
5,107,184 A * 4/1992 Hu et al. ..... 307/40

FOREIGN PATENT DOCUMENTS

AU 3079889 9/1989
AU 199922429 10/1999

* cited by examiner

*Primary Examiner*—Don Wong
*Assistant Examiner*—Ephrem Alemu
(74) *Attorney, Agent, or Firm*—Ladas & Parry

(57) ABSTRACT

A switching circuit which facilitates electrically controlled actuation of a switching device, such as a relay, in a two-wire circuit where access may be gained only to an active conductor. The switching circuit includes an electrically actuatable switching device which is arranged to be connected in series with a load in the form of a lamp in a single phase as circuit. A solid state second switching device is connected in series with the first switching device. A first energy storage device is connected across the first and second switching devices and a second energy storage device is connected across the second switching device. Gating circuitry associated with the second energy storage device is provided to effect periodic ON-OFF gating of the second switching device during the time that the first switching device is actuated to a conducting state.

8 Claims, 2 Drawing Sheets

TWO-WIRE CONTROLLED SWITCHING

FIELD OF THE INVENTION

This invention relates to an electrical circuit which facilitates electrically controlled actuation of a switching device in a two-wire circuit where access may be gained only to an active or line conductor (herein referred to as an active conductor). The invention has been developed in relation to remotely controlled lighting circuits, for example lighting circuits that are switched responsive to an output being obtained from a timer or a motion detector, and the invention is hereinafter described in such context. However, it will be understood that the invention does have broader application.

BACKGROUND OF THE INVENTION

Lighting circuits in buildings typically are powered from twin-core (active and neutral) wiring that is located above ceilings of the buildings. Also, twin-core wiring normally is used for connecting a wall switch in circuit between an above-ceiling active conductor and the active side of a ceiling-mounted light fitting. That is, in a typical building situation a neutral conductor is not normally available below ceiling level and provision does not, therefore, exist for taking power from the circuit below ceiling level. Therefore, provision cannot conveniently be made for effecting electrically controlled switching of lighting, for example by using a relay that requires power to energise its coil.

Various so-called two-wire switch circuits have been devised for effecting controlled switching of lighting, using only an active conductor. In one such circuit, for example that disclosed in Australian Patent No. 608416 dated Feb. 28, 1989, a triac is employed as a controlled switch, but this approach creates heat dissipation problems in confined spaces, particularly with relatively large currents in the order of 10 amps. In a practical approach to the problem, a capacitor has been used in circuit with a bistable relay and charged to its maximum level when the relay is open. The capacitor charge is then used to energise the relay ON coil, when the relay is to be actuated to a closed condition, but the relay may be maintained in a closed condition only for such time as it takes for the capacitor to discharge to a level below that at which the relay OFF coil is energised.

Another approach has involved the use of a step-up transformer and reverse connected diodes for supplying latching current to a relay coil, but this is not suitable for use in restricted space situations.

Yet another approach has involved a circuit as disclosed by the present Applicant in Australian Patent Application No. 22429/99, dated Mar. 26, 1999. However, that circuit has required the use of an expensive Shottky diode and heat sinking for dissipating average power in the order of 2–3 watts.

SUMMARY OF THE INVENTION

The present invention provides an alternative approach to the problem, one which facilitates sustained actuation of a controlled switching device, such as a relay and which, in a preferred form, provides for electrically controlled actuation of the switching device over a wide range of load currents.

Broadly defined, the present invention provides a switching circuit which comprises:

(a) an electrically actuatable first switching device which is arranged to be connected in series with a load in a single phase ac circuit, (b) a solid state second switching device connected in series with the first switching device, (c) a first energy storage device connected across the first and second switching devices and arranged under controlled conditions to deliver actuating power to the first switching device, (d) a second energy storage device connected across the second switching device and arranged to store energy for gating the second switching device, (e) gating circuitry associated with the second energy storage device and arranged to effect periodic OFF-ON gating of the second switching device during the time that the first switching device is actuated to a conducting state, and (f) circuit connections between the junction of the first and second switching devices and the first and second energy storage devices, the circuit connections providing for charge replenishment of the first energy storage device and charging of the second energy storing device during the OFF gating periods of the second switching device.

In operation of the switching circuit, the first energy storage device is employed as a source of energy for actuating and latching the first switching device. The first energy storage device is charged to its full capacity over an initial time period following connection of the circuit to a supply voltage but prior to actuation of the first switching device to a conducting condition. Thereafter, when the first switching device has been actuated to a conducting condition, loss of charge from the first energy storage device is replenished with periodic OFF-ON gating of the second switching device. This process is described in more detail later in this specification.

PREFERRED FEATURES OF THE INVENTION

The first switching device may comprise a solid state switching device when employed in relatively low power applications, but it preferably comprises a relay having a coil which is energised by an actuating signal that is derived from the first energy storage device. That is, the relay coil is provided with actuating/latching current that is derived from the first energy storage device under controlled conditions.

In the interest of minimising unacceptable heat losses and/or in order to obviate the need for heat sinking, the solid state second switching device preferably comprises a low impedance device, that is one which, in its conducting state, exhibits an impedance that causes a voltage drop which is not greater than about 500 mV rms with a current flow of 10 amps rms. The second switching device most preferably comprises a metal oxide semi-conductor field effect transistor (MOSFET) device.

The gating circuitry preferably is arranged to gate the second switching device to an OFF condition during an initial time interval in each positive half-cycle of the supply and, thereafter, to gate the second switching device ON for the remaining positive half-cycle and the next succeeding negative half-cycle of the supply. By taking this approach the need for a Schottky diode (and associated heat sink), as required in one of the previously acknowledged prior art approaches, is avoided.

During the time interval that the second switching device is gated OFF the voltage rise across the second switching device is employed to drive charging current to both the first and the second energy storage devices. However, the gating circuitry is effectively disabled unless and until the first switching device is actuated to a conducting condition.

The time interval during which the second switching device is gated to an OFF condition preferably is selected to cause a voltage rise across the device in the order of 10 to 20 volts.

The switching circuit as above defined preferably incorporates a processor that is arranged to effect the controlled actuation of the first switching device responsive to an input signal from a manual switching device, a proximity detector, a light level sensor, a motion detector, a remote control (IR or rf) signal sensor or other such device.

The invention will be more fully understood from the following description of a preferred embodiment of a switching circuit. The circuit is described with reference to the accompanying drawings.

DETAILED DESCRIPTION OF THE INVENTION

Figure 1:
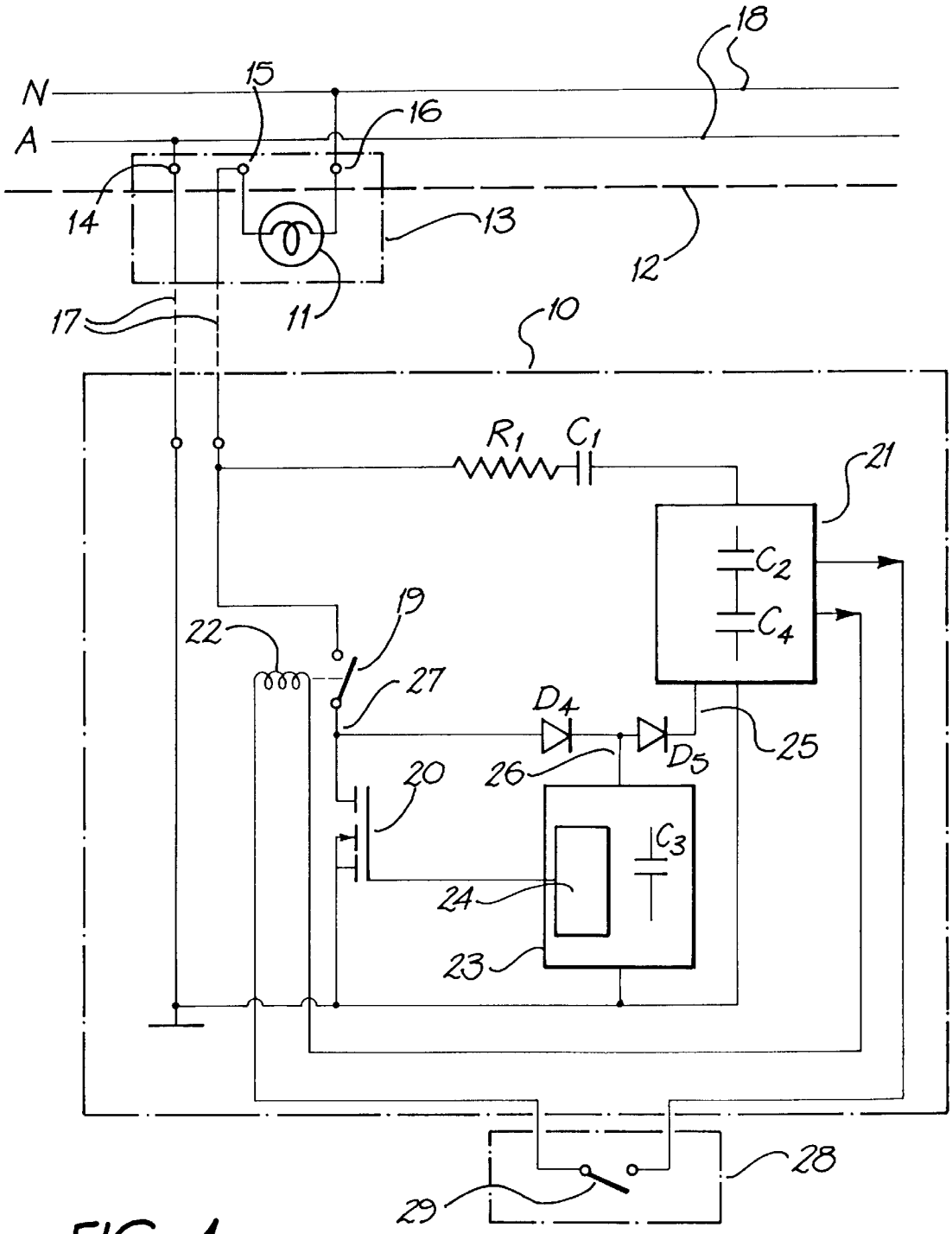
FIG. 1 shows a partly diagrammatic, partly schematic diagram of the switching circuit.

As illustrated in FIG. 1, the switching circuit 10 is employed for controlling energisation of a incandescent lamp 11 that is mounted to a ceiling 12. The lamp is mounted to a fitting 13 that includes a looping terminal 14, a switched-active terminal 15 and a neutral terminal 16. The switching circuit is connected by a two-wire conductor 17 to the active and switched active terminals of the lamp fitting 13.

A two-wire single phase ac supply 18 is provided in the usual way above the ceiling 12.

The switching circuit 10 comprises an electrically actuated first switching device 19, in the form of an electromagnetic relay, and a series-connected solid state second switching device 20 in the form of a MOSFET. The two switching devices 19 and 20 are connected in a series circuit with the lamp 11 and, thus, across the active-neutral supply 18.

A first energy storage device 21 (that includes two capacitors $C_2$ and $C_4$) is connected across (i.e. in parallel with) the first and second switching devices 19 and 20 and is arranged under controlled conditions (as hereinafter described) to deliver actuating power to the coil 22 of the relay 19. Also, a second energy storage device 23 (that includes a capacitor $C_3$) is connected across the MOSFET 20 and is arranged to store energy for gating the MOSFET 20.

Gating circuitry 24 associated with the MOSFET 20 is provided to effect periodic OFF-ON gating of the MOSFET 20 during the time when the relay 19 is actuated to a conducting condition.

A circuit connection 25 is made between the relay-MOSFET junction 27 and the first energy storage device 21 to provide charge replenishment of the first energy storage device (by way of capacitor $C_2$) following actuation of the relay 19 and during OFF gating periods of the MOSFET 20. Also, a circuit connection 26 (by which the second energy storage device 23 is connected across the MOSFET 20) provides for periodic charging of the second energy storage device 23 (i.e. charging of the capacitor $C_3$) during the OFF gating periods of the MOSFET 20.

A separate control circuit 28 is provided for initiating operation of the switching circuit 10. The control circuit 28 is shown schematically in FIG. 1 as comprising a manually operable ON-OFF switch 29. However, the control circuitry would normally comprise or incorporate some sort of processor circuitry of the type shown (by way of example only) in FIG. 2 of the drawings.

The operation of the switching circuit 10 is now described with reference to both of FIGS. 1 and 2.

As a starting condition, it is assumed that the relay 19 is open (i.e. de-energised) and that, with no power available to the gating circuit 24, the MOSFET 20 is non-conducting. Then, current will pass through the lamp 11 during successive positive half-cycles (with the active at zero volts with respect to the energy storage devices, as indicated) to charge capacitor $C_2$ and through the active connection during successive negative half-cycles to charge the capacitor $C_4$. Depending upon the lamp resistance, the capacitors $C_2$ and $C_4$ will normally be fully charged to a total (series) voltage level of 48 volts, as determined by Zener diodoes ZD2 and ZD4, over approximately a 20-cycle time period.

At any time thereafter, with operation of the switch 29, the relay 19 is actuated to a conducting condition. Energising power for the relay coil is derived from the capacitors $C_2$ and $C_4$. Thereafter, with the voltage rise that occurs over an initial period in the first and each subsequent positive half-cycle of the supply, the drain voltage at the MOSFET device 20 will cause current flow through the diode D4 to charge the capacitor $C_3$ and through diode D5 to replenish the charge at capacitor $C_2$.

When capacitor $C_3$ is charged to a level at which Zener diodoes ZD1 and ZD3 conduct, an output from latch U1A is employed to gate the MOSFET 20 to an ON condition for the remaining duration of the period of the positive half-cycle and the next succeeding negative half-cycle of the supply. It is important to note that it is only following the initial setting and subsequent resetting of the latch U1A that the MOSFET 20 is gated to the ON condition. Prior to closure of the relay 19, the capacitor $C_3$ is not charged, this guaranteeing that the MOSFET 20 is initially latched OFF.

Moreover, at the commencement of each positive half-cycle of the supply, the latch reset U1B senses the voltage rise and functions to reset the latch U1A to an OFF condition, this in turn resulting in the MOSFET being gated OFF for an initial period of time as determined by the charging time of capacitor $C_3$. Charge replenishment of the first energy storage device 21 and charging of the second energy storage device 23 is effected during a minimum interval (say, 0.5 to 1.5 mS) of each positive half-cycle of the supply.

Figure 2:
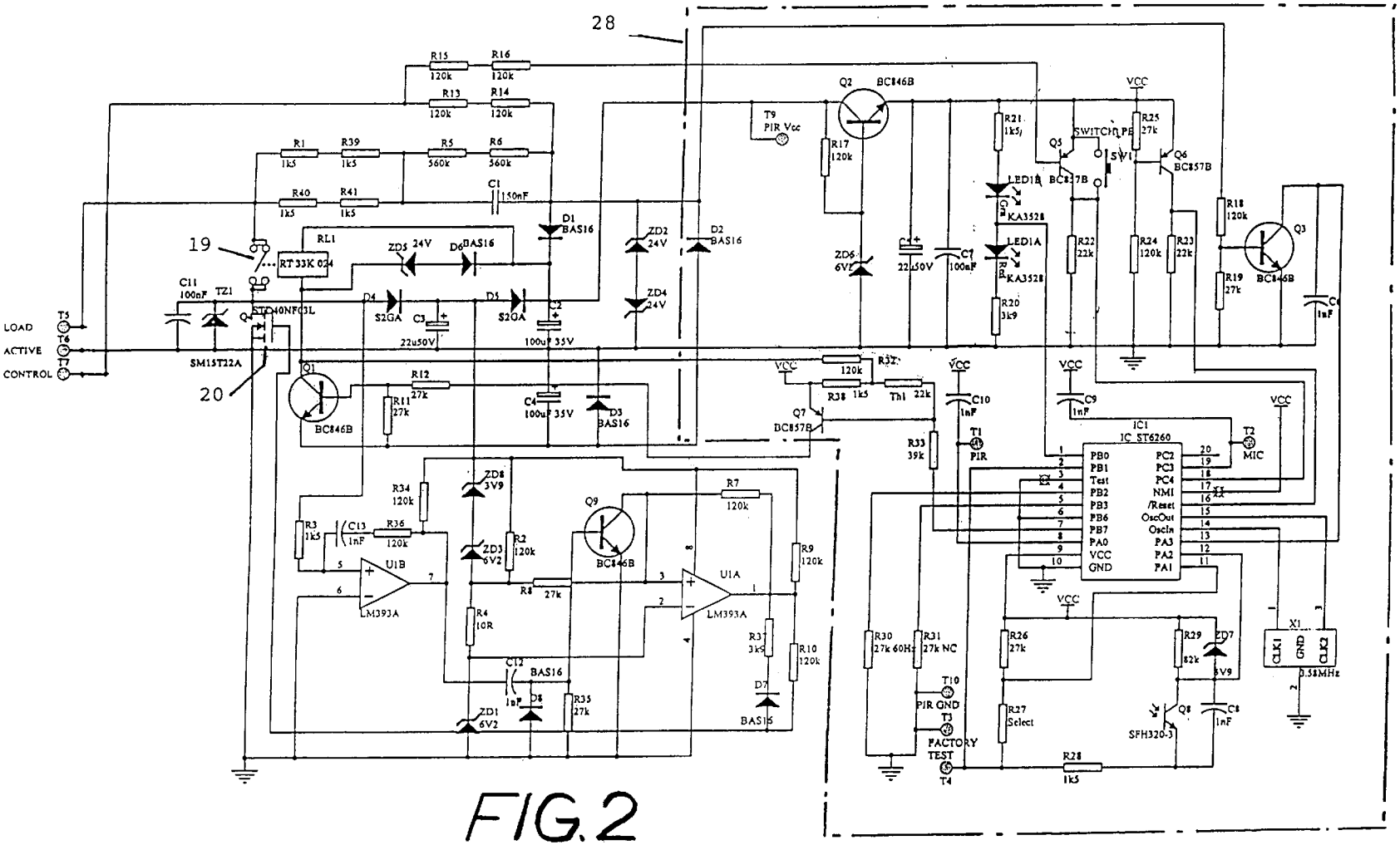
FIG. 2 shows a schematic wiring diagram which incorporates components of the switching circuit as shown in FIG. 1 and, additionally, optional processing circuitry.

The requirements for and the functions of the various circuit components that are shown in FIG. 2, but not specifically identified, will be understood by readers who are familiar with conventional circuit design. The circuitry that is shown in FIG. 2 may be adapted to meet specific load and other requirements whilst functioning within the scheme indicated in FIG. 1.

However it is observed that, by choosing a low value for the latch offset resistor R4, as shown in FIG. 2, the switching circuit may be employed with lamps (or other loads) having a wide operating power range. In the case of a relatively large load, the circuit will operate in the manner as above described and current will flow through both the relay 19 and the MOSFET 20. However, in the event that the load current is very small, a low voltage drop will appear across the resistor R4, the latch U1A will not be operated and the load current will flow through the resistor R4, rather than through the MOSFET, during each positive half-cycle of the supply.

Then, during each negative half-cycle of the supply, the current will flow through the MOSFET, utilising the intrinsic reverse diode characteristic of MOSFET devices. Depending upon the various circuit parameters, the device may be adapted to accommodate a load current range of between 20 mA to 16 A, i.e. over nearly three orders of magnitude.

What is claimed is:

1. A switching circuit which comprises:

(a) an electrically actuatable first switching device which is arranged to be connected in series with a load in a single phase ac circuit, (b) a gate driven solid state second switching device connected in series with the first switching device, (c) a first energy storage device connected across the first and second switching devices and arranged under controlled conditions to deliver actuating power to the first switching device, (d) a second energy storage device connected across the second switching device and arranged to store energy for gating the second switching device, (e) gating circuitry associated with the second energy storage device and arranged to effect periodic OFF-ON gating of the second switching device during the time that the first switching device is actuated to a conducting state, and (f) circuit connections between a junction of the first and second switching devices and the first and second energy storage devices, the circuit connections providing for charge replenishment of the first energy storage device and charging of the second energy storing device during the OFF gating periods of the second switching device, wherein the gating circuitry is arranged to gate the second switching device to an OFF condition during an initial time interval in each positive half-cycle of the ac supply and, thereafter, to gate the second switching device ON for the remaining positive half-cycle and the next succeeding negative half-cycle of the ac supply, and wherein, during the time interval that the second switching device is gated OFF, the voltage rise across the second switching device is employed to drive charging current to both the first and the second energy storage devices.

2. The switching circuit as claimed in claim 1 wherein the first energy storage device comprises at least one capacitor.

3. The switching circuit as claimed in claim 1 wherein the second energy storage device comprises at least one capacitor.

4. The switching circuit as claimed in claim 1 wherein the first switching device comprises an electromagnetic relay having an actuating coil connected in circuit with the first energy storage device.

5. The switching circuit as claimed in claim 1 wherein the second switching device comprises a MOSFET device.

6. The switching circuit as claimed in claim 1 wherein the gating circuitry is arranged effectively to be deactivated prior to actuation of the first switching device to a conducting condition.

7. The switching circuit as claimed in claim 6 wherein the gating circuitry includes a latch which is arranged initially to latch the MOSFET OFF and a latch reset which functions following a predetermined positive voltage rise to reset the latch to an ON condition and to gate the second switching device.

8. The switching circuit as claimed in claim 7 wherein circuitry associated with the latch includes a low value offset resistor which is arranged to carry load current, that would otherwise flow through the second switching device, in the event that the voltage drop across the resistor is insufficient to set the latch and gate the second switching device ON in successive half-cycles of the ac supply.

* * * * *